United States Patent [19]

Ashley

[11] Patent Number: 4,474,377

[45] Date of Patent: Oct. 2, 1984

[54] ELEVEN-PLANE CUBICAL PUZZLE

[76] Inventor: Jonathan J. Ashley, 3367 N. McCall, Sanger, Calif. 93657

[21] Appl. No.: 410,445

[22] Filed: Aug. 23, 1982

[51] Int. Cl.[3] ..... A63F 9/08

[52] U.S. Cl. ..... 273/153 S

[58] Field of Search ..... 273/153 S

[56] References Cited

PUBLICATIONS

Scientific American, Jul. 1982, pp. 20 and 23–25.

*Primary Examiner*—Anton O. Oechsle

[57] ABSTRACT

The eleven-plane cubical puzzle, shown in FIG. 1, is a puzzle in the shape of a cube whose twenty-four exposed pieces may be permuted by rotations of groups of said pieces about any of seven axes passing through the vertices and the centers of the faces of said cube.

1 Claim, 6 Drawing Figures

ELEVEN-PLANE CUBICAL PUZZLE

SUMMARY OF THE INVENTION

The eleven-plane cubical puzzle, shown in FIG. 1, is a puzzle in the shape of a cube. The section of the puzzle on one side of any one of eleven planes is free to rotate with respect to the section of the puzzle on the other side of said plane about an axis perpendicular to said plane passing through the center of the cube. Said eleven planes are of two types. Three of the eleven planes are parallel to and midway between a pair of opposite faces of the cube. Note that the axes of rotation perpendicular to these three planes each pass through the center of face; hence these axes will be called face axes. The remaining eight planes are those planes that contain an equilateral triangle formed by three vertices of the cube. Note that the axes of rotation perpendicular to these eight planes each pass through a vertex of the cube; hence these axes will be called vertex axes.

In the unscrambled position of the puzzle each face of the cube is colored a single color distinct from those of the other faces. This coloring pattern may be scrambled by a series of rotations of various sections of the puzzle by integer multiples of 90° about face axes and by integer multiples of 120° about vertex axes. The object of the puzzle is to return by means of a series of such rotations to the unscrambled coloring pattern.

BRIEF DESCRIPTION OF THE DRAWINGS

All drawings view the components of the puzzle from a common vantage.

FIG. 2 shows a section of the puzzle subject to rotation about a vertex axis exploded outward from the remainder of the puzzle.

FIG. 3 shows the pieces of the core of the puzzle exploded outward a common distance from their installed positions.

FIG. 4 shows the assembled core and also shows the eight vertex pivot bases exploded outward from their installed positions on the core.

FIG. 5 shows the installed vertex pivot bases and also shows four of the eight vertex pivots exploded outward from their installed positions on the bases.

FIG. 6 shows the installed vertex pivots and also shows eight of the twenty-four wedges exploded outward from their installed positions between the vertex pivots.

DESCRIPTION OF THE PREFERRED EMBODIMENT

Figure 1:
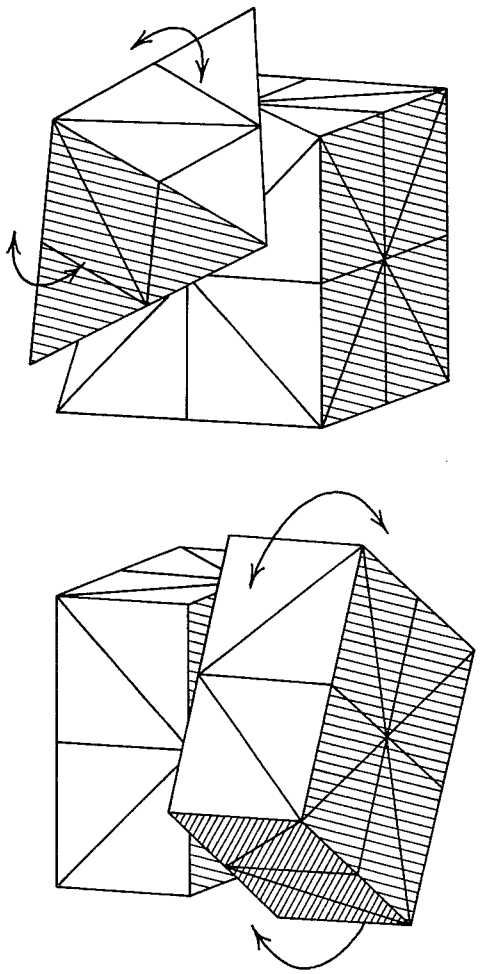
FIG. 1 shows two views of the assembled puzzle. The top view shows a section of the puzzle rotated about a vertex axis, and the bottom view shows a section rotated about a face axis.

FIG. 1 shows two views of the assembled eleven-plane cubical puzzle. The puzzle, in the shape of a cube, is constructed in such a way (described below) that any section of the puzzle on one side of a plane containing an equilateral triangle formed by three vertices of said cube may be rotated about a vertex axis with respect to the section of the puzzle on the other side of said plane. The top view in FIG. 1 shows such a rotation. Moreover, any section of the puzzle on one side of a plane parallel to any midway between a pair of opposite faces of said cube may be rotated about a face axis with respect to the section of the puzzle on the other side of said parallel plane. The bottom view in FIG. 1 shows such a rotation.

Figure 2:
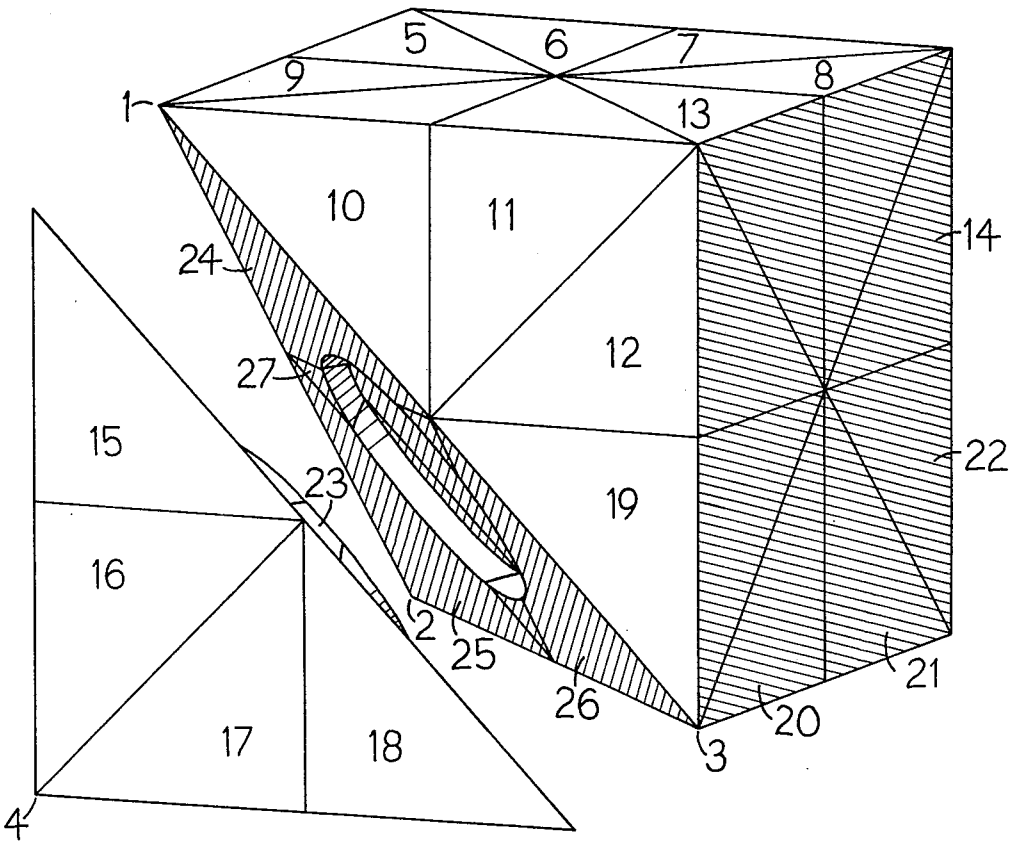
FIGS. 2 through 6 are drawn at twice the scale of FIG. 1.

FIG. 2 shows a section of the puzzle subject to rotation about a vertex axis exploded outward from the remainder of the puzzle. The division in the puzzle along which the puzzle is shown separated in FIG. 2 may be described as follows. For convenience, the length of the edge of the puzzle will be taken to be one unit of length in all that follows. The division comprises two planar surfaces and one cylindrical surface. The first of said planar surfaces lies in the plane containing the three vertices labeled 1, 2, and 3. Said planar surface is bounded on the outside by the equilateral triangle formed by vertices 1, 2, and 3 and is bounded on the inside by the circle of intersection of the plane 1, 2, 3 with the cylinder of radius 0.27 units whose axis passes through the center of the cube and through vertex 4. Said cylindrical surface consists of the length of said cylinder stretching from the plane 1, 2, 3 to a second plane parallel to plane 1, 2, 3 positioned a distance of 0.05 units towards the center of the cube from plane 1, 2, 3. The second of said planar surfaces consists of the region in said second plane which is interior to said cylinder.

If such a division is made corresponding to each vertex of a solid cube in the way that the described division corresponds to vertex 4, and if said cube is further divided along each of the three planes parallel to and midway between pairs of opposite faces, then said cube will be divided into forty pieces of three shapes: twenty-four wedges, eighteen of which are visible as pieces 5 through 22; eight pieces, four of which are visible as pieces 23 through 26, that, when modified as described below, become vertex pivots; and eight pieces, one of which is visible as piece 27, that, when modified as described below, become vertex pivot bases.

Figure 3:
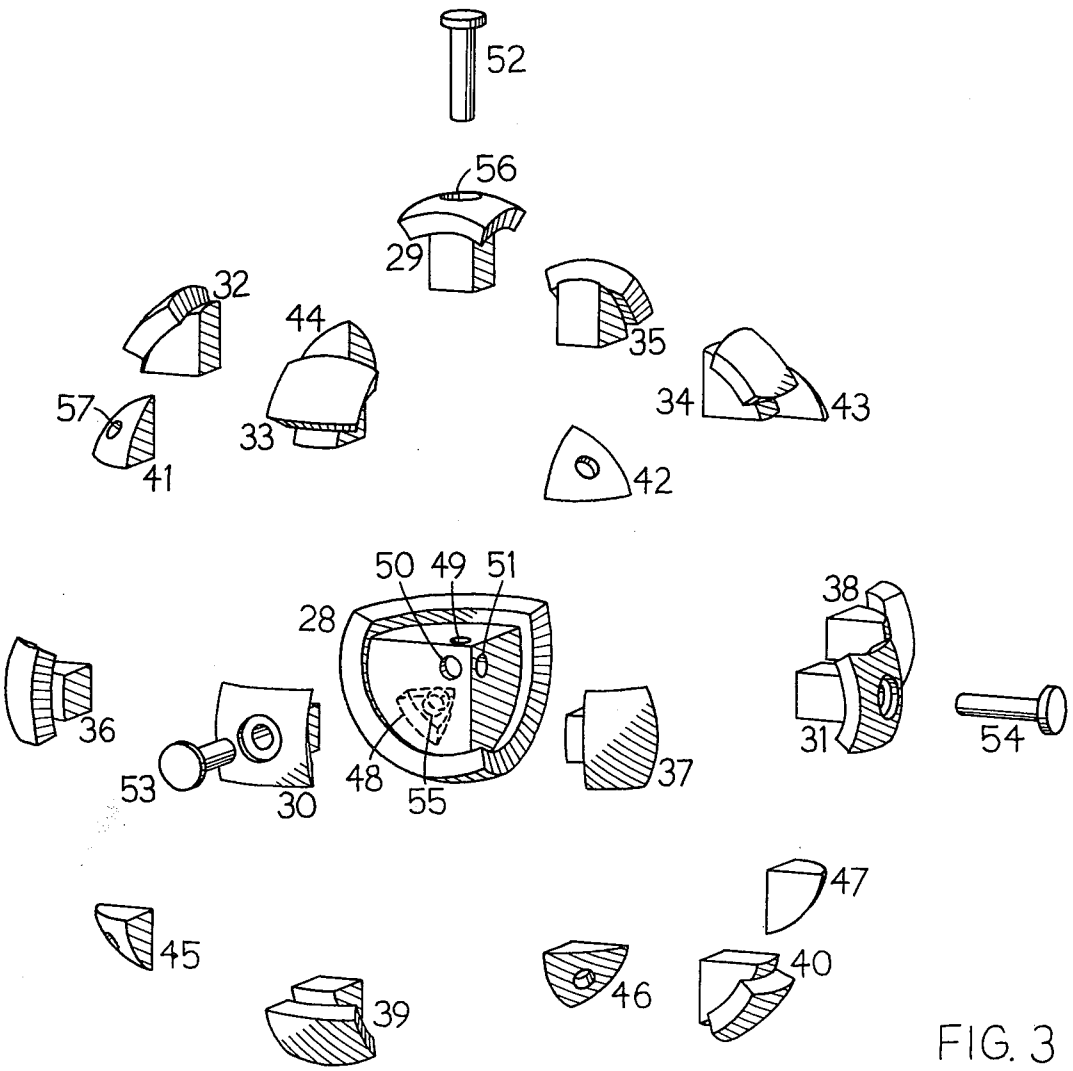

FIG. 3 shows the pieces of the core of the puzzle exploded outward from their installed positions on the core base 28, face pivots 29, 30, and 31, and keys 32 through 40 each comprise a section of a spherical shell (said shell concentric with the puzzle and of inner radius 0.16 units and outer radius 0.20 units) rigidly fixed to a section of a solid sphere (said sphere concentric with the puzzle and of radius 0.16 units). The pivot retainers 41 through 47 each consist of a section of said solid sphere.

In describing said sections of said spherical shell it is convenient to fix in mind the six cones, each of apex angle 130°, each with apex at the center of said puzzle, that respectively open upward, downward, leftward, rightward, forward, and backward along face axes. These will be denoted respectively as the up, down, left, right, front, and back cones. In describing said sections of said solid sphere it is convenient to fix in mind six planes as follows. Imagine a small cube of edge length 0.08 units concentric with the puzzle and whose faces are parallel with the corresponding faces of the puzzle. The plane containing the top face of said small cube will be denoted as the up plane. Similarly, the planes containing the other faces of said small cube will be denoted as the down, left, right, front, and back planes.

Using these terms, the core base 28, face pivots 29, 30, and 31, keys 32 through 40, and pivot retainers 41 through 47 will now be described. The core base 28 comprises the section of said solid sphere simultaneously below the up plane, left of the right plane, and behind the front plane; said section being rigidly fixed to the section of said spherical shell simultaneously outside the up cone, outside the right cone, and outside the front cone. The trianglular section of said spherical shell which lies simultaneously inside the down, left, and back cones is also excised from the core base, leaving a triangular hole 48. Three cylindrical holes 49, 50, and 51 are drilled along the up face axis, fron face axis, and right face axis respectively, to accept the up, front, and right face pivot pins 25, 26, and 27, respectively. A cylindrical pivot pins 52, 53, and 54, respectively. A cylindrical hole 55 is drilled in the center of triangular hole 48.

The face pivot 2 comprises the section of said solid sphere simultaneously above the up plane, between the left and right planes, and between the front and back planes; said section being rigidly fixed to the section of said spherical shell simultaneously inside the up cone and outside the left, right, front, and back cones. A countersunk cylindrical hole 56 is drilled along the up face axis to accept the up face pivot pin 52. The other two face pivots 30 and 31 are shaped exactly the same as the described face pivot 29.

The key 32 comprises the section of said solid sphere simultaneously above the up plane, left on the left plane, and between the front and back planes; said section being rigidly fixed to the section of said spherical shell simultaneously inside the up cone, inside the left cone, outside the front cone, and outside the back cone. The other eight keys 33 through 40 are shaped exactly the same as the described key 32.

The pivot retainer 41 comprises the section of said solid sphere simultaneously above the up plane, left of left plane, and in front of the front plane. A cylindrical hole 57 is drilled in the pivot retainer 41 along a vertex axis to accept a vertex pivot pin. The other six pivot retainers 42 through 47 are shaped exactly the same as the described retainer 41.

Figure 4:
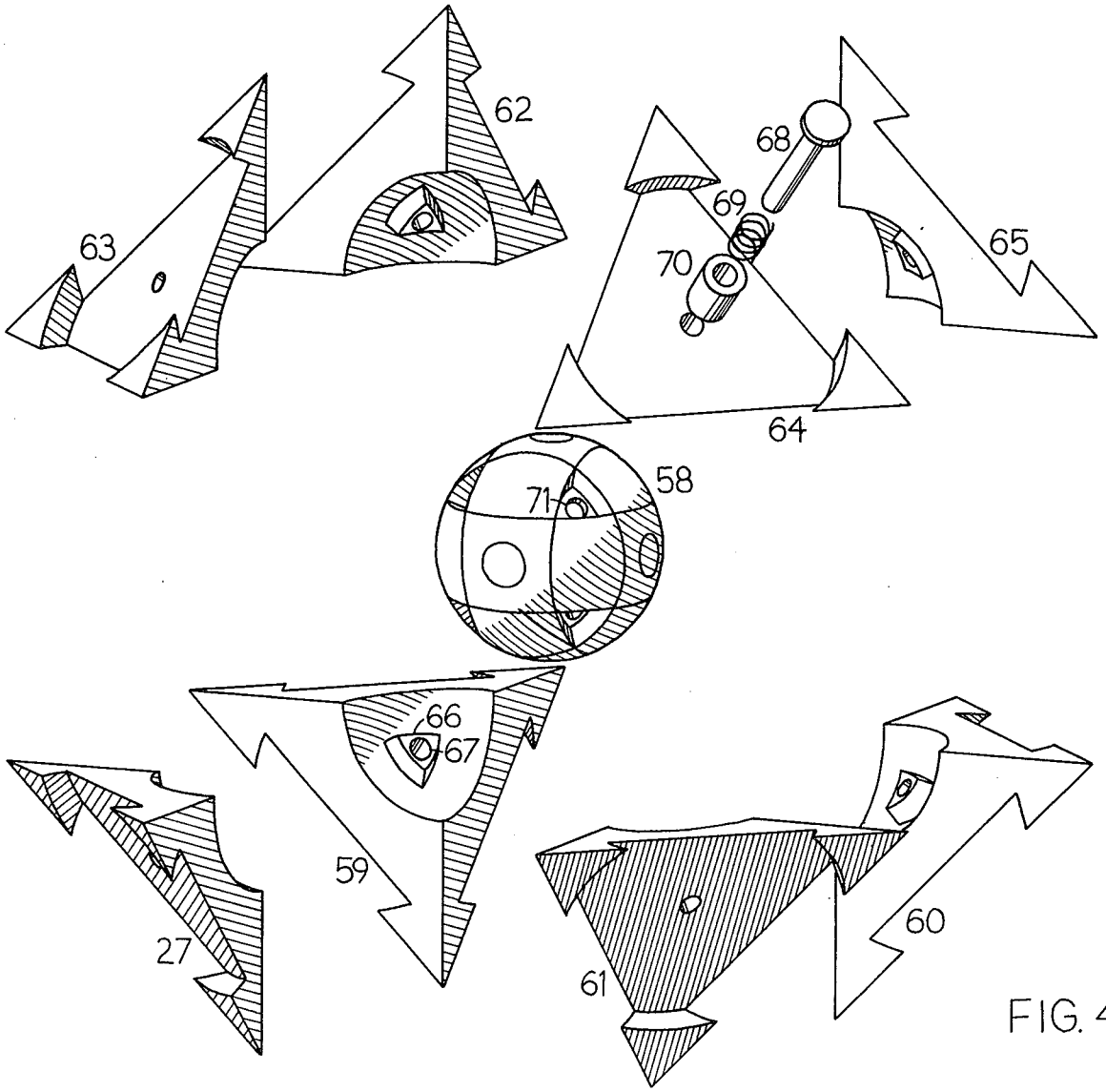

The final steps in the assembly of the core are to slip the face pivot pins 52, 53, 54 through the face pivots 29, 30, 31 and to cement said pins into holes 49, 50, 51. FIG. 4 shows the assembled core 58. Each pivot is free to rotate, along with its four surrounding keys and its four surrounding pivot retainers, about the pin which holds said pivot to the core base.

FIG. 4 also shows the eight vertex pivot bases 27, 59, 60, 61, 62, 63, 64, 65 exploded outward from their installed positions on the core 58. Vertex pivot base 59 has an inside spherical surface of radius 0.20 units concentric with said puzzle. Vertex pivot base 59 has a triangular section 66 of spherical shell rigidly fixed to said spherical surface so as to conform to the triangular hole in the core 58. A cylindrical hole 67 is drilled along a vertex axis to accommodate a vertex pivot pin. The other seven vertex pivot bases 27, 60, 61, 62, 63, 64, 65 are shaped exactly the same as the described pivot base 59.

In installing vertex pivot base 64 on the core 58, a vertex pivot pin 68 is slipped through a spring 69, a bushing 70, and the vertex pivot base 64, and cemented in the hole in the pivot retainer 71 and also cemented in the hole in the vertex pivot base 64. The bushing 70 remains free to rotate about pin 68.

Figure 5:
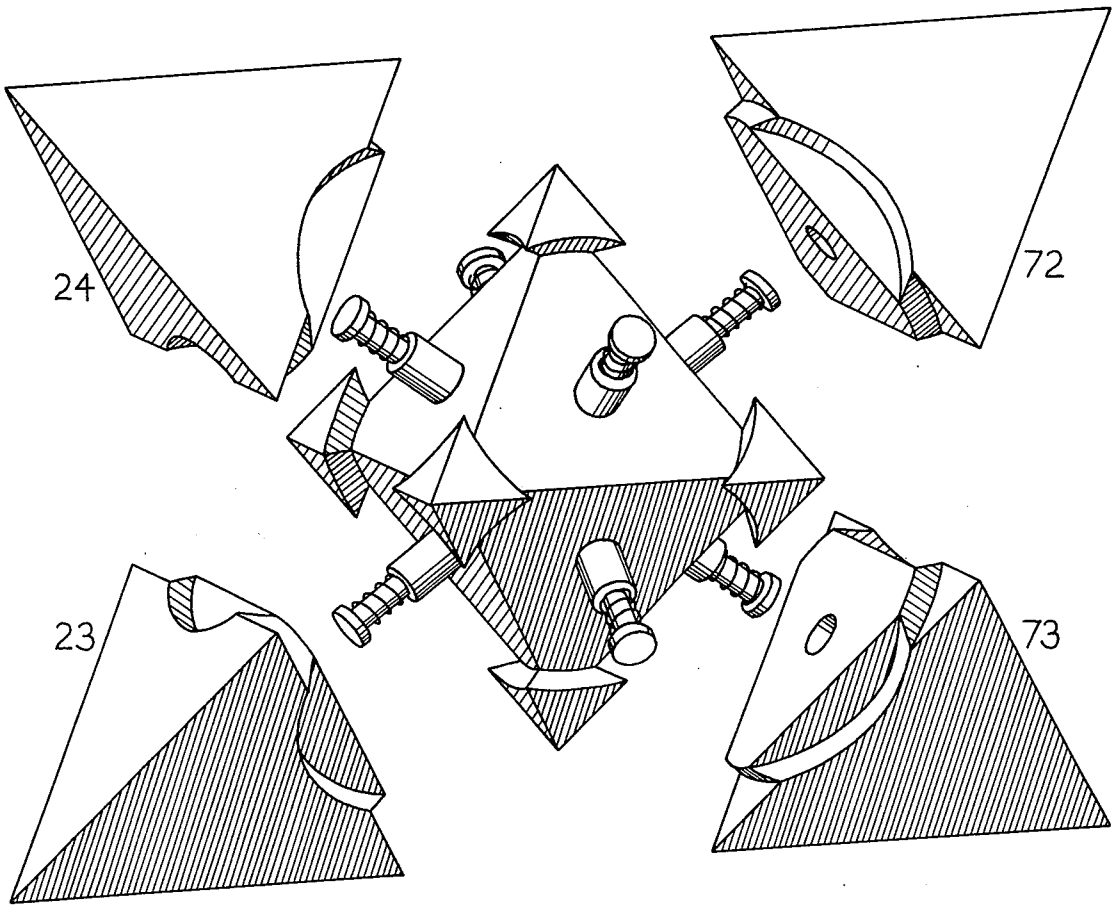

FIG. 5 shows the eight vertex pivot bases installed on the core. Any group of four vertex pivot bases meeting at a corner of the octahedral assembly of which they are part are free to rotate about a face axis relative to the remaining four vertex pivot bases.

FIG. 5 also shows four of the eight vertex pivots 23, 24, 72, 73 exploded outward from their installed positions on the vertex pivot bases. Each vertex pivot has a cylindrical hole drilled in it along a vertex axis to accommodate a vertex pivot pin, spring, and bushing. In installing a vertex pivot, it is slipped over a vertex pivot pin, spring, and bushing and cemented to the bushing. The vertex pivot and bushing to which it is cemented are free to rotate about their vertex pivot pin. The vertex pivots are spring loaded so as to enable the assembler to pull them outward in order to install the wedges between them.

Figure 6:
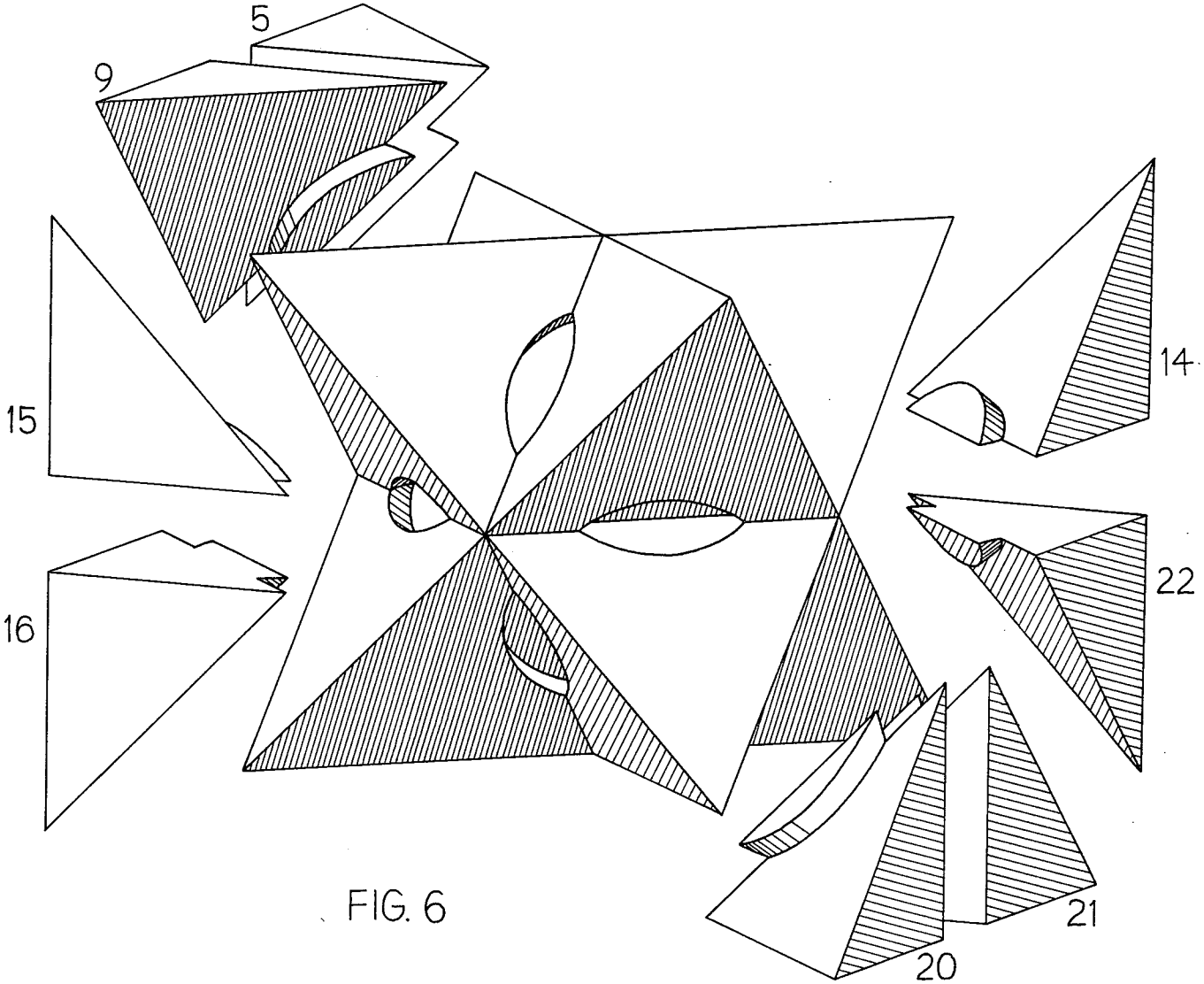

FIG. 6 shows the eight vertex pivots installed. FIG. 6 also shows eight 5, 9, 14, 15, 16, 20, 21, 22 of the twenty-four wedges exploded outward from their installed positions between the vertex pivots. In the assembled puzzle the vertex pivots retain the wedges in the puzzle.

The foregoing is considered as illustrative only of the principles of the invention. Further, since numerous modifications and changes will readily occur to those skilled in the art, it is not desired to limit the invention to the exact construction shown and described, and accordingly all suitable modifications and equivalents may be resorted to, falling within the scope of the invention as claimed.

What is claimed as new is as follows.

1. A puzzle in the shape of a cube whose exterior surface is defined by twenty-four pieces, termed wedges, each including two exposed right isosceles triangular faces disposed at a right angle to each other to define a portion of an edge of the cube extending from a respective corner to the midpoint of said edge; means maintaining said wedges in an assembled array whereby they may be permuted by rotations of two types about seven axes each disposed on one side of eleven distinct planes, one type being the rotation of the group of six wedges lying on one side of any plane that contains an equilateral triangle defined by three vertices of the cube about a vertex axis by some integer multiple of 120°, and the other type being the rotation of the group of twelve wedges lying on one side of any plane parallel to and midway between an opposite pair of faces of the cube about a face axis by some integer multiple of 90°; the exposed faces of said wedges being colored in a pattern which may be scrambled and unscrambled by a series of such rotations.

* * * * *